US005595008A

United States Patent [19]

*Johnson

[11] Patent Number: 5,595,008

[45] Date of Patent: Jan. 21, 1997

[54] GREETNG CARD DEVICE

[75] Inventor: Keith D. Johnson, Inglewood, Calif.

[73] Assignee: United Pacific Development, Los Angeles, Calif.

[ * ] Notice: The term of this patent shall not extend beyond the expiration date of Pat. No. 5,435,085.

[21] Appl. No.: 364,122

[22] Filed: Dec. 27, 1994

Related U.S. Application Data

[63] Continuation-in-part of Ser. No. 235,451, Apr. 29, 1994, Pat. No. 5,435,085.

[51] Int. Cl.[6] ..... G09F 1/00

[52] U.S. Cl. ..... 40/124.1; 47/66; 283/117

[58] Field of Search ..... 40/124.1, 539; 446/146, 148; 47/66 C, 41.01; 283/117; 218/31

[56] References Cited

U.S. PATENT DOCUMENTS 1,885,879 11/1932 Whittington ..... 428/23 X
4,415,183 11/1983 Benham ..... 281/31
4,584,213 4/1986 Rentowl ..... 40/124.1 X
4,917,240 4/1990 Roberts et al. ..... 206/232
4,949,482 8/1990 Price ..... 40/124.1
5,251,746 10/1993 Gresh et al. ..... 281/31 X
5,293,706 3/1994 Wood ..... 40/124.1
5,435,085 7/1995 Johnson ..... 40/124.1

*Primary Examiner*—Brian K. Green
*Attorney, Agent, or Firm*—Robert J. Schaap

[57] ABSTRACT

A greeting card device comprised of a pair of foldable panels and having an inner foldable receptacle capable of retaining water for retention of a living plant. The receptacle contains an inner liner enabling the retention of water. In this way, the greeting card serves not only to present a greeting, but also functions as a plant holder and which may store the very grown plant which is given to the receiver, along with the greeting card. After decay of the living plant, the receptacle can be used for the retention of artificial plant items, such as artificial flowers. In addition, the receptacle can be used for the retention of potpourri, or like dried flowers which have been impregnated or treated with a scent, such as a perfume, scented oil or the like. Thus the greeting card becomes a relatively permanent item, as opposed to one which is disposable and immediately discarded.

17 Claims, 3 Drawing Sheets

GREETNG CARD DEVICE

RELATED APPLICATION

This application is a continuation-in-part of my U.S. patent application Ser. No. 235,451 filed Apr. 29, 1994 now U.S. Pat. No. 5,435,085, dated Jul. 25, 1995.

BACKGROUND OF THE INVENTION

1. Field of the Invention

This invention relates in general to certain new and useful improvements in a novel greeting card device including a greeting card and combination of plant support and more particularly, to a novel greeting card and plant support in which a plant, such as a flower, can be held in the greeting card.

2. Brief Description of the Prior Art

Greeting card are well known and have been commercially available in one form or another for well over 100 years. While advances have been made in the art of greeting cards, such as in the types of paper, the printing involved and the like, the cards have essentially remained unchanged.

Most commercially available greeting cards usually comprise a single sheet of paper or a paper stock material or paperboard stock material so that a pair of panels which lie in facewise engagement with one another is provided. Usually printing is provided on one or more faces of these panels and may or may not be accompanied by illustrations or other designs.

There have also been several embodiments of greeting cards which utilize three or more panels. Again, these greeting cards may contain various forms of printed material and/or artistic material presented thereon. Beyond the fact that the greeting cards usually have a plurality of panels with artistic and graphic materials presented thereon, very little has changed in the art of greeting cards over the years.

It is a common practice to bequeath flowers or grown plants along with a greeting card, particularly on special occasions, such as birthdays, certain holidays and the like. In all cases, the grown plant will usually accompany the greeting card in a separate package or it may be inserted temporarily between the two panels of a greeting card when given to a recipient. However, after the recipient receives the greeting card with the grown plant, the plant is removed and introduced into a separate vase with water.

In essentially all cases, the greeting card itself usually becomes disposable and is discarded within a few days after receipt. This is at least partially due to the fact that the greeting card itself has no other utilitarian purpose. In many cases, the grown plant is retained for a much longer period than the greeting card. As a result, the greeting card has little utility and does become disposable.

There has been a need for a unique and novel greeting card in which a grown plant can be kept with the greeting card. However, the grown plant itself will very quickly die if not supported, at least in a body of water.

OBJECTS OF THE INVENTION

It is, therefore, one of the primary objects of the present of the present invention to provide a novel greeting card device which has means for permanently supporting a plant therein.

It is another object of the present invention to provide a novel combination greeting card and plant support for holding a plant in the greeting card.

It is a further object of the present invention to provide a novel greeting card device which supports a plant by providing an integral housing for receiving a grown plant stem.

It is an additional object of the present invention to provide a novel greeting card device of the type stated in which a housing formed in the greeting card can also support a body of water in which a grown plant may be disposed.

It is another salient object of the present invention to provide a novel greeting card device of the type stated which renders the greeting card device permanently useful and eliminates the quick disposal of the greeting cards normally found with conventional greeting cards.

It is yet another object of the present invention to provide a greeting card and plant support of the type stated which is relatively inexpensive to manufacture, but which is highly useful and effective for maintaining a greeting card and a plant combination.

With the above and other objects in view, my invention resides in the novel features of form, construction, arrangement and combination of parts presently described and pointed out in the claims.

SUMMARY OF THE INVENTION

A novel greeting card device may exist in the combination of a greeting card and a grown plant support for holding a plant in that greeting card. The greeting card of the invention may preferably be formed of conventional paper or paper board stock material of the type used in the formation of conventional greeting cards.

The greeting card assembly of the present invention usually includes a plurality of panels, such as a pair of panels connected along a fold line. The exterior faces of these panels may be provided with printed messages or otherwise with graphic illustrations thereon and, for that matter, one or both of the interior panels could have portions thereof provided with such printed material or graphic illustrations, or both.

Located in the panels of the greeting card are a pair of hingedly connected pocket forming walls which together with the interior surfaces of the panels form a plant support in the nature of a receptacle for a stem of a plant. This pair of hingedly connected walls usually lies in flat facewise engagement with the panels when the panels are disposed in a closed position. However, when the panels are opened at a 90 degree angle, the interior walls will also separate and become disposed to one another at approximately a 90 degree angle. Thus, the interior surfaces of the pair of panels and the pair of walls form a somewhat rectangularly shaped receptacle for receipt of the stem of a plant.

In one embodiment of the invention, the interior housing has a central pocket which may be closed by a bottom wall. In this case, the bottom wall may be comprised of a pair of bottom sections which may be connected to the panels or the pocket forming walls and which bend downwardly to form a relatively flat bottom wall. In another embodiment, the central pocket is not provided with a rigid bottom wall formed of the same material as the card itself. In this case, a plastic liner is secured within the walls forming the pocket and the liner itself is in the form of a sack which includes a bottom wall.

The greeting card device of the present invention is also provided with a very flexible and foldable plastic sack secured within the vest pocket of the housing in this case, the interior chamber of the housing. Preferably, the plastic liner is tubular and is open only at its upper end, such that it is capable of supporting water therein. The upper end of the liner has upper edges which are turned over and secured to the interior surface of the panels or to the pocket forming walls of the housing.

In accordance with the above-identified construction, when a recipient receives the card device, he or she can open it to a position where they are capable of reading and observing the printed messages and the graphics thereon. The recipient may also receive a grown plant and in which case, the recipient can immediately fill the plastic liner with water and introduce the stem of the grown plant into the water. Thus, when the greeting card has its panels disposed at approximately a 90 degree angle relative to one another, the pocket forming walls will also assume a 90 degree angle with respect to one another and with respect to the panels to which they are attached.

This greeting card device provides an ideal housing for holding a plant, such as a flower, for a substantial period of time. Moreover, it is designed to hold the flower, or other plant, right in the greeting card itself. Consequently, the greeting card becomes a useful object which actually can function as not only an element which portrays a message, but also supports the grown plant bequeathed with it.

The novel greeting card of the invention can also be used for the support and holding of artificial plants after a decay of the actual grown plant. Moreover, the receptacle formed in the greeting card can also be used for the retention of potpourri and similar dried plant materials which may have been impregnated with a suitable fragrance. Thus, the greeting card itself serves as a useful item which can be retained for a substantial period of time and thus, becomes a permanently retained greeting card.

The term "plant" as used herein, is used in a broad sense to refer to any item which may be, represents, or is derived from a grown plant as for example, green-leafed plants, flowers and the like. The term "plant" would thus encompass artificial plants, such as nylon-based items which are designed to appear as a real plant, etc. The invention also encompasses and the term "plant" is also used to include items derived from these grown plants, such as dried and fragranced plant items, including potpourri and the like.

This invention possesses many other advantages and has other purposes which may be made more clearly apparent from a consideration of the forms in which it may be embodied. These forms, as shown in the drawing forming a part of and accompanying the present specification. They will now be described in detail for purposes of illustrating the general principles of the invention, but it is to be understood that the following detailed description and the accompanying drawings are not to be taken in a limiting sense.

BRIEF DESCRIPTION OF THE DRAWINGS

Figure 1:
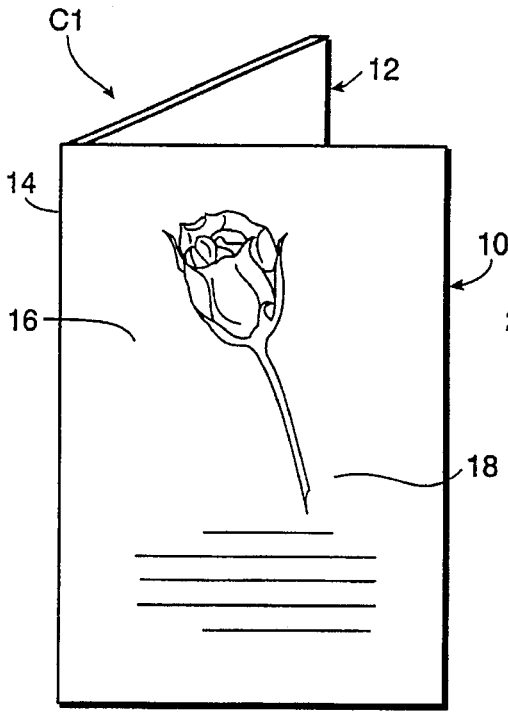
Figure 2:
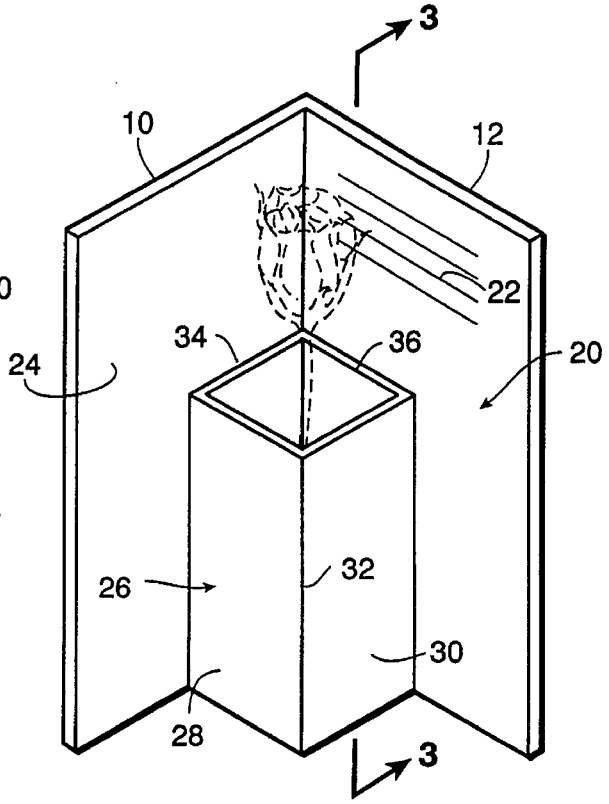
Figure 3:
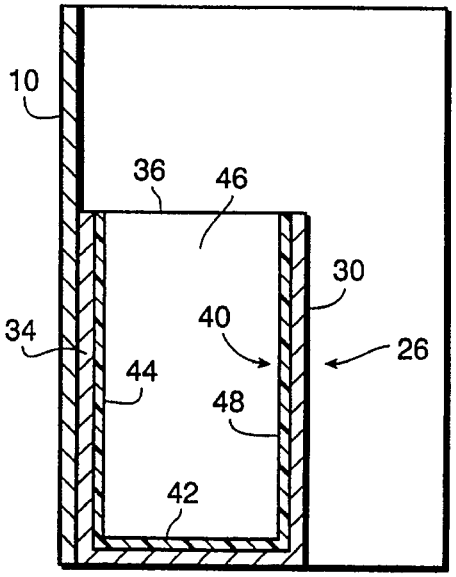
Figure 4:
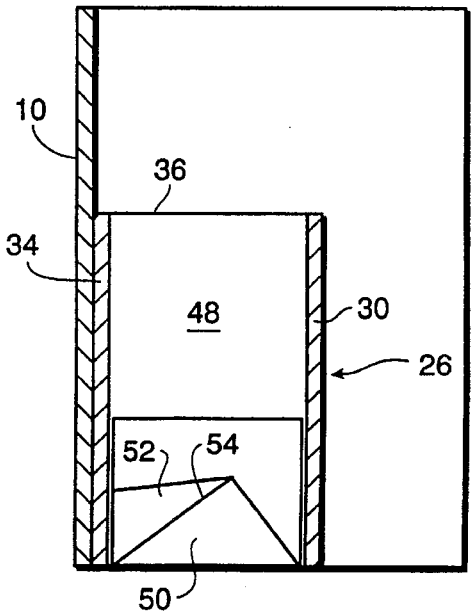
Figure 5:
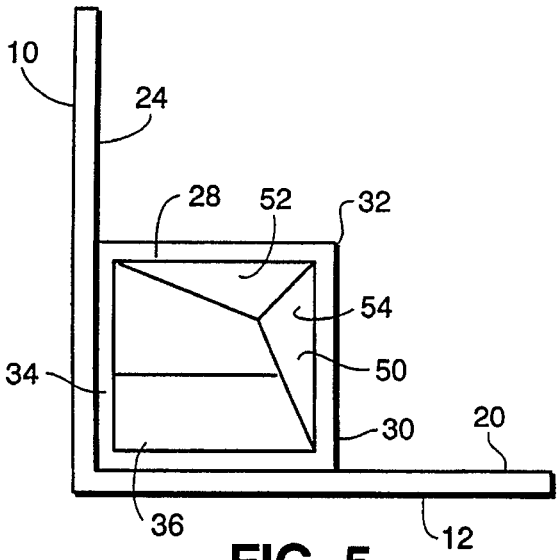
Figure 6:
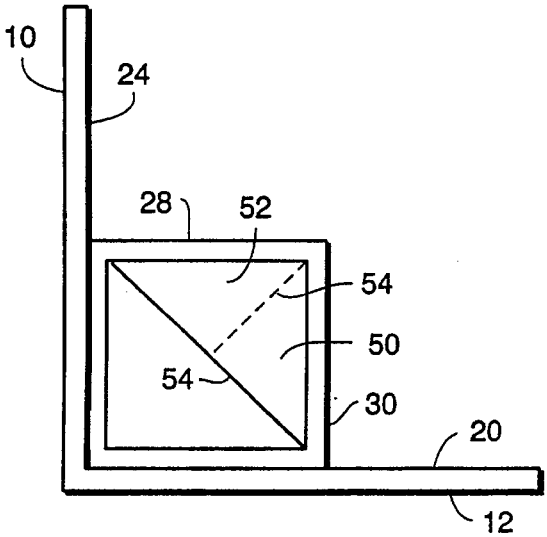
Figure 7:
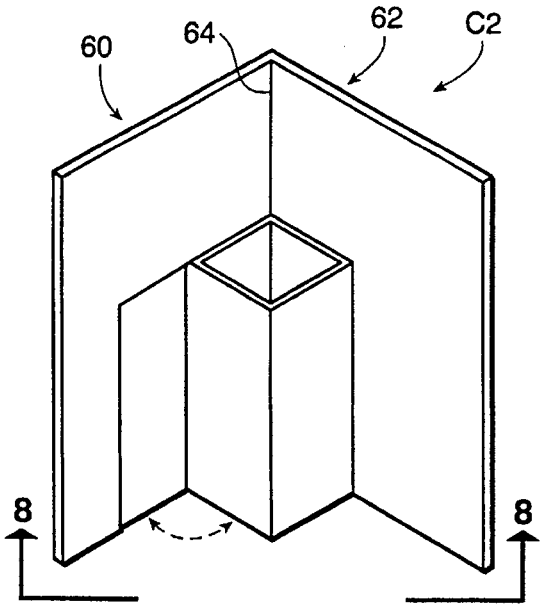
Figure 8:
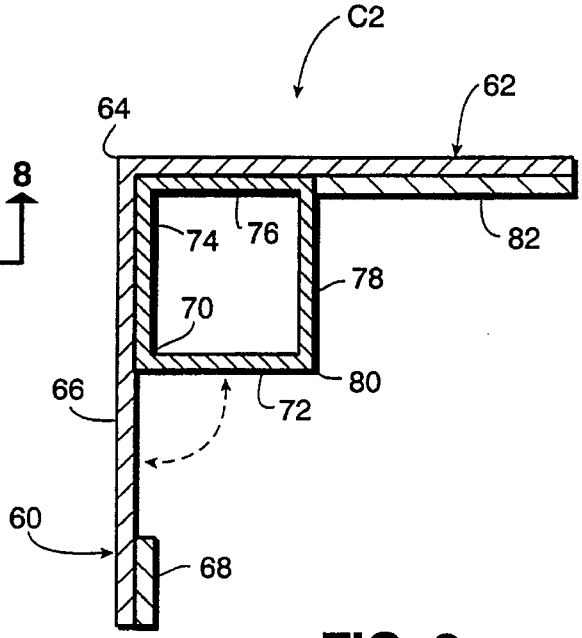
Figure 9:
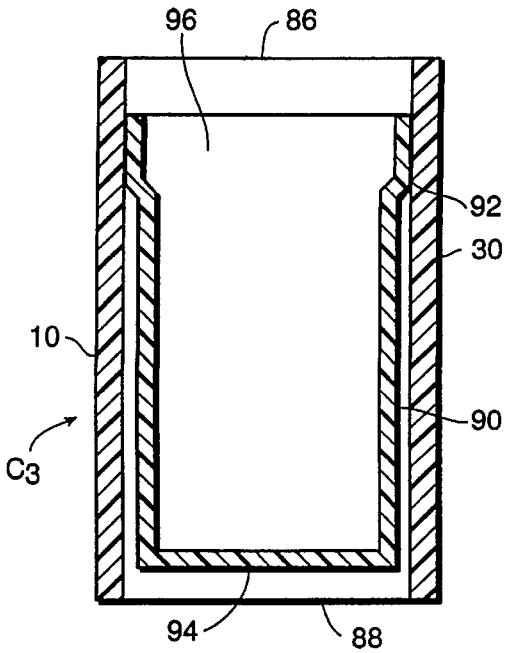
Figure 10:
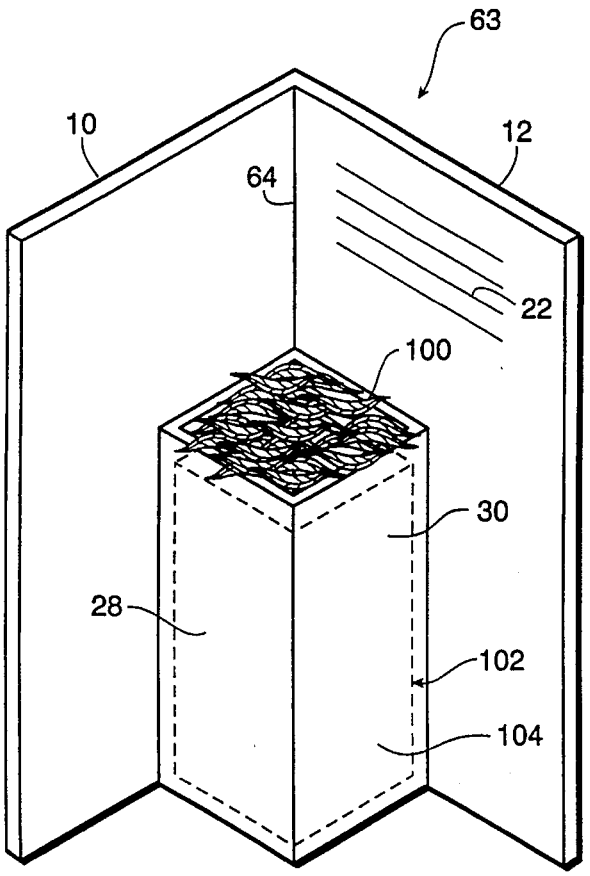
Figure 11:
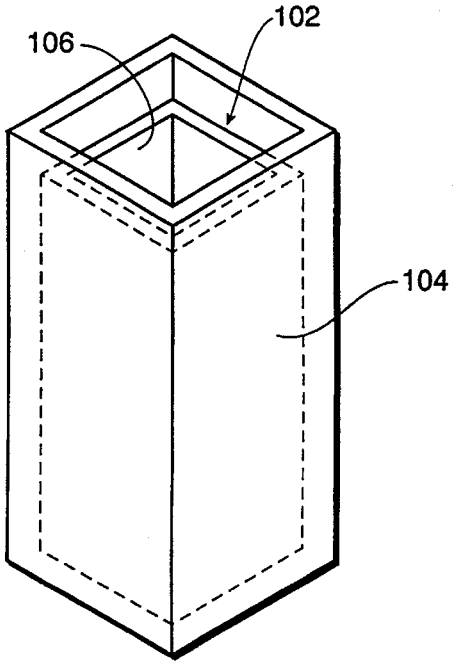

Having thus described the invention in general terms, reference will now be made to the accompanying drawings (two sheets) in which:

FIG.1 is an exterior perspective view of a novel greeting card device constructed in accordance with and embodying the present invention;

FIG. 2 is an interior perspective view of a novel greeting card device constructed in accordance with and embodying the present invention;

FIG. 3 is a vertical sectional view taken substantially along line 3—3 of FIG. 2;

FIG. 4 is a vertical sectional view, similar to FIG. 3, and showing a portion of the components forming part of the grown plant-receiving receptacle when the bottom wall thereof is in a folded up condition;

FIG. 5 is a bottom plan view of the greeting card device with the bottom wall of the receptacle in a partially opened condition;

FIG. 6 is a bottom plan view, similar to FIG. 5, and showing the bottom wall of the receptacle in a fully opened position for supporting a grown plant stem;

FIG. 7 is an interior perspective view of a slightly modified form of greeting card device constructed in accordance with and embodying the present invention;

FIG. 8 is a bottom plan view taken substantially along the plane of line 8—of FIG. 7;

FIG. 9 is a vertical sectional view of a slightly modified form of novel greeting card device constructed in accordance with and embodying the present invention;

FIG. 10 is a perspective view, similar to FIG. 7, and showing the disposition of potpourri in the receptacle; and FIG. 11 is a fragmentary perspective view, similar to FIG. 9, and showing an insert in the receptacle for retention of potpourri and like substances.

DETAILED DESCRIPTION OF A PREFERRED EMBODIMENT

Referring now in more detail and by reference characters to the drawings which illustrate several practical embodiments of the present invention, $C_1$ designates a novel greeting card device which is comprised of a front panel 10 and a rear panel 12 connected along a suitable hinge line 14. In this case the hinge line 14 is essentially a fold line which allows the two panels 10 and 12 to be swingable relative to one another.

Printed on the front face 16 of the panel 10 is a message or illustration 18. In like manner, printed on an interior face 20 of the rear panel 12 is a further message 22. The message 22 may form a part or cooperate with the message 18. It should be understood that additional messages used and/or graphic illustrations could be incorporated on the interior face 24 of the panel 10 or the rear face of the rear panel 12.

Secured to the interior face 24 of the panel 10 and the interior face 20 of the panel 12 is a housing or receptacle 26 having an interior pocket and which is comprised of a pair of receptacle forming walls 28 and 30 connected at a receptacle hinge line 32. The housing or receptacle 26 also has another pair of receptacle forming walls 34 and 36 which are facewise disposed upon and respectively secured to the interior face 24 of the panel 10 and the interior face 20 of the rear panel 12, also as best shown in FIGS. 2–4 of the drawings.

In accordance with this construction, when the two panels 10 and 12 are open at approximately a 90 degree angle, as shown in FIG. 2, the walls 28 and 30 will also assume a perpendicular arrangement with respect to the panels 10 and 12, thereby forming an open interior chamber in the receptacle 26. A stem of a grown plant may then be disposed within the interior chamber 38.

Located within the interior chamber 38 is a plastic liner 40 having an enclosed bottom wall 42 and an enclosing side wall 44, but which has an opened upper end 46. The upper edges of the side wall 44 are adhesively secured to the interior surface of the receptacle forming walls 28 and 30, and possibly the walls 34 and 36, forming part of the housing 26. In this way, the liner 40 provides an interior trough or pocket 48 capable of holding water.

When it is desired to maintain the greeting card device in a closed position, it can be observed that the two receptacle forming walls 28 and 30 will also fold along the hinge line 32 so that they, in effect, become facewise disposed against the interior surfaces 24 and 20 of the panels 10 and 12. The interior faces of the receptacle forming walls 34 and 36 will also become disposed in flatwise engagement with one another when the greeting card panels 10 and 12 are shifted to the closed position. This will allow the greeting card to assume a fully closed position in the same manner as a conventional greeting card.

A pair of bottom wall sections 50 and 52 are also provided in the receptacle 26, as shown in FIGS. 4–6 of the drawings. These bottom wall sections 50 and 52 are effectively folded against the interior surfaces of the receptacle-forming walls 34 and 36 when the panels 10 and 12 are in the closed position. The bottom wall sections 50 and 52 are suitably connected along a fold line 54. However, when the panels 10 and 12 are moved to an opened position, the triangularly shaped bottom wall sections 50 and 52 will then begin to open to form a partial bottom wall, as shown in FIG. 6.

FIG. 5 shows the bottom wall sections 50 and 52 in a position where they are still partially folded up and FIG. 6 shows the bottom wall sections 50 and 52 in a position where they have formed a partially enclosing bottom wall 54 in a plane which is perpendicular to the plane of the receptacle-forming walls 28 and 30 and the receptacle-forming walls 34 and 36. This bottom wall 54 which is triangularly shaped is still rigid and supportive of water within the receptacle and the plant which is retained therein. Moreover, the bottom wall 54 can be folded up such that the two bottom wall sections 50 and 52 are folded along the fold line 54 and again assume a facewise disposition against the interior surfaces of the receptacle-forming walls 32 and 34.

It can be seen that the greeting card device of the present invention is highly effective in that it allows a sender of a greeting or present to include a flower or like grown plant having a stem along with a greeting card itself. The greeting card device of the invention provides a suitable receptacle which is sized for holding the grown plant. In this way, the grown plant will be retained with the greeting card and more importantly, the greeting card itself will be retained by the recipient.

One of the unique aspects of the invention is that the greeting card itself literally will cause the formation of the grown plant receptacle when the greeting card is opened and rested in an upright position on the bottom edges of the two panels thereof located at approximately a 90 degree angle relative to one another. Moreover, the plastic liner included in the receptacle is sufficient to hold water. Thus, the greeting card itself actually serves as a type of flower holder.

As also indicated above, the greeting card, and particularly the receptacle portion thereof, will also serve to retain an artificial plant or dried plants and similar plant-like elements.

Thus, even after decay of the grown plant, the greeting card can become a permanently retained item.

FIGS. 7–8 illustrate a modified form of greeting card device $C_2$ which is comprised of a pair of panels 60 and 62 connected along a hinge line, such as a fold line, 64. Again, these panels 60 and 62 may have the same exteriorly presented or interiorly presented messages and/or graphic illustrations as in the greeting card $C_1$. The panel 60 in this embodiment is constructed of a pair of sandwich plies 66 and 68, as shown. Thus, and in this respect, the panel 60 is actually of a two-ply construction. The panel 62 is of a single-ply construction, as hereinafter described in more detail.

A portion of the ply 68 is effectively sliced from the ply 66 and is bent along a fold line 70 to form a receptacle-forming wall 72. A second receptacle-forming wall 74 is actually formed of the ply 68. Another receptacle-forming wall 76 is facewise disposed against and is secured to the interiorly presented face of the panel 62, as best shown in FIGS. 7 and 8. The receptacle forming walls 72 and 76 are also connected to another receptacle forming wall 78 and which is hingedly connected to the wall 72 along a hinge line 80.

An interior filler ply 82 is also secured to the interior surface of the panel 62, as shown in FIG. 8. In this way, the remaining portions of both panels will essentially have the same thickness. The additional ply 82 is also effective in that it can be pre-printed with a desired message. For example, a plurality of additional filler panels 82 may be employed with each having different messages and a selected message can be incorporated on the greeting card device, merely by attaching the filler panel 82 to the panel 62.

The greeting card device $C_2$ thereby effectively forms the same function as the greeting card device $C_1$. In this respect, the greeting card device $C_2$ would also include a plastic liner located within the receptacle for holding a grown plant.

FIG. 9 illustrates a slightly modified form of greeting card device $C_3$ which is similar to the greeting card device $C_1$, except that it does not include a rigid foldable bottom wall comprised of the bottom wall sections 50 and 52. Rather, in this case, the interior chamber of the pocket is provided with an open top 86 and an opened bottom 88. In this embodiment of the invention, a plastic liner 90 is secured at its upper end around the entire periphery thereof to the receptacle with an adhesive sealant 92, as shown in FIG. 9. The plastic liner 90 exists in the form of a bag and may be sealed by any convenient suitable adhesive material at the seal 92. It is to be noted by reference to FIG. 9 that the liner 90 inherently includes an integral bottom wall 94 which thereby forms an upper open-ended pocket 96 to receive water and a grown plant. This embodiment of the invention is not as rigid as the embodiment as shown in FIGS. 1–8, since it does not provide the rigidity afforded by the bottom wall. However, it is less costly to manufacture and easier for use by the consumer.

FIG. 10 illustrates the use of a greeting card $C_4$ which is substantially identical to the greeting card $C_1$ or $C_2$ and which uses the receptacle for the retention of a dried plant 100, such as potpourri. Thus, after decay of a grown plant, or even in an absence of a grown plant, potpourri can be inserted in the receptacle so that the greeting card again becomes a permanently retained item. In another mode, the potpourri can be submitted as a gift along with the greeting card and with the potpourri usually included in some type of packaging. Thus, after the user has opened and read the greeting card, the user can then open the package of potpourri and inset the potpourri in the receptacle.

Due to the fact that the potpourri usually comprises the dried leaves and blossoms of a grown plant, and which are further processed, there is no stem to retain the potpourri in a generally upright position. Thus, a paperboard insert 102 may be inserted in the receptacle. For this purpose, the paperboard insert is comprised of four rectangularly arranged walls 104 and having a top wall 106. The rectangularly arranged walls 104 have a height slightly less than the overall height of the receptacle. In this way, the depth of the receptacle becomes sufficiently shallow to support potpourri in a manner in which it will extend at least to, if not above, the surface of the receptacle, as shown in FIG. 10.

The insert 102 can be formed of any suitable paper or paperboard material, and typically of the same material used in the formation of the greeting card. In like manner, it could also be collapsible and used when desired for the purposes of supporting potpourri and like dried plant materials.

Thus there has been illustrated and described a unique and novel greeting card device which offers the availability of a greeting card and a retainer for a plant conveyed with the greeting card. In this way, the greeting card device fulfills all of the objects and advantages which have been sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A novel greeting card device which presents a greeting message and provides for retention of an article in relationship to the greeting card device, said greeting card device comprising:

a) a pair of panels hingedly connected to one another and which are capable of having interior surfaces facewise disposed against one another and separated so that the panels are angularly located relative to one another;

b) means hingedly connecting the panels to one another;

c) a message on at least one of the panels for presenting a greeting message to a recipient of the greeting card device;

d) pocket forming means located between the two panels for opening and supporting the card device in an upright position upon placing the panels in an angular relationship relative to one another to form a pocket which is sized to receive an article to be presented to the recipient of the greeting card device;

e) a pair of walls forming part of said pocket forming means hingedly connected respectively to interior surfaces of each of said panels and being disposed in flat facewise engagement with interior surfaces of the panels when the panels are closed and which walls open and have portions spaced outwardly from the interior surfaces of the panels upon placing the panels in an angular relationship relative to one another to form a pocket, said walls assuming an angular relationship similar to that of the pair of panels when the pair of panels are angularly located relative to one another;

f) said panels having lower and upper edges and where the lower edges are sized and shaped to be supported on a flat surface so that the pocket is upwardly opening and the panels are vertically arranged when the card device is opened and in use; and g) a waterproof liner secured to said pair of walls and capable of retaining water therein when a grown plant stem is introduced into the liner in said pocket and to be presented to the recipient of the greeting card device within the pocket.

2. The greeting card device of claim 1 further characterized in that the means for hingedly connecting the panels is a fold line between the pair of panels.

3. The greeting card device of claim 1 further characterized in that one of the walls is generally parallel to one of the panels and the other of the walls is generally parallel to the other of the panels when the panels are placed in the angular relationship.

4. The greeting card device of claim 1 further characterized in that the pair of panels are normally closed in a position where the interior surfaces of each of the panels are facewise disposed against one another and opened to a position where the two panels can be located at a 90 degree angle relative to one another and rested on their lower edges.

5. The greeting card device of claim 1 further characterized in that the pair of walls, along with portions of the interior surfaces of the panels, form a somewhat rectangularly shaped pocket when the two panels are arranged at a 90 degree angle relative to one another.

6. The greeting card device of claim 5 further characterized in that each of the pair of walls are facewise disposed against an interior surface of each of the panels when the two panels are located in facewise engagement with one another.

7. The greeting card device of claim 1 further characterized in that the greeting card device provides for retention of a grown plant or artificial plant or dried plant substance.

8. The greeting card device of claim 7 further characterized in that an insert is introduced in the plant receiving pocket to raise the lower level of the plant receiving pocket and thereby store plants which do not necessarily have an elongate stem.

9. The greeting card device of claim 1 further characterized in that the means associated with the lower end of said pocket is a bottom wall associated with at least one of the walls and is capable of being located in perpendicular relationship to each of the walls when the walls are opened relative to one another.

10. The greeting card device of claim 1 further characterized in that at least one of the panels is formed of a pair of plies and that one of the plies is used to form an additional wall in the receptacle.

11. A novel greeting card device which presents a written or pre-printed greeting and provides for retention of a grown plant in relationship to the greeting card device, said greeting card device comprising:

a) a first paper material panel;

b) a second paper material panel hingedly connected to said first paper material panel;

c) a first wall hingedly connected to an interior surface of said first panel;

d) a second wall hingedly connected to an interior surface of said second panel when said first and second panels are facewise disposed against one another;

e) a waterproof liner disposed within a pocket formed by the interior surfaces of each of the said panels and interior surfaces of each of said walls for retaining water and supporting a stem of a grown plant stem;

f) a hinge means hingedly connecting the other ends of said first and second walls to one another such that said walls open with respect to the panels to form a pocket sized to receive an article to be presented to a recipient of the greeting card device when the panels are opened, said walls lying against the interior surfaces of said first and second panels when the first and second panels are closed;

g) said panels having lower and upper edges and where the lower edges are sized and shaped to be supported on a flat surface so that the pocket is upwardly opening and the panels are vertically arranged when the card device is opened and in use; and h) means associated with a lower end of said pocket to retain an article to be presented to the recipient of the greeting card device within the pocket.

12. The greeting card device of claim 11 further characterized in that said walls are hingedly connected to one another at their opposite ends and assume an angular relationship relative to one another similar to that assumed by the panels.

13. The greeting card device of claim 12 further characterized in that each of said walls are capable of being disposed in perpendicular relationship relative to one another when the two panels are located in a perpendicular relationship relative to one another.

14. The greeting card device of claim 13 further characterized in that opposite faces of said walls have interior surfaces which are disposed in facewise engagement with one another when the panels are closed and the opposite surfaces of said walls are disposed in facewise engagement with the interior surfaces of each of said panels when the panels are shifted to a closed position.

15. A method of presenting a greeting on a greeting card and retaining a plant in relation to the greeting card, said method comprising:

a) hingedly moving a pair of panels forming part of the greeting card relative to one another so that the panels are angularly disposed with respect to one another in an opened position and facewise disposed against one another in a closed position;

b) causing the opening of a pair of walls located between the panels when the panels are moved to the opened position and thereby forming a pocket between the walls;

c) presenting a message on a surface of at least one of the panels; and d) forming a pocket between the walls and inserting a plant in the pocket when the panels have been shifted to the opened position.

16.The method of claim 15 further characterized in that the plant is a grown plant and the method comprises pouring water into a plastic liner retained by said walls when holding the stem of a plant.

17. A novel greeting card device which presents a greeting message and provides for retention of an article in relationship to the greeting card device, said greeting card device comprising:

a) a pair of panels hingedly connected to one another and which are-capable of having interior surfaces facewise disposed against one another and separated so that the panels are angularly located relative to one another;

b) means hingedly connecting the panels to one another;

c) a message on at least one of the panels for presenting a greeting message to a recipient of the greeting card device;

d) pocket forming means located between the two panels for opening and supporting the card device in an upright position upon placing the panels in an angular relationship relative to one another to form a pocket which is open ended at both its upper end and its lower end and which is sized to receive an article to be presented to the recipient of the greeting card device;

e) a pair of walls forming part of said pocket forming means hingedly connected respectively to interior surfaces of each of said panels and being disposed in flat facewise engagement with interior surfaces of the panels when the panels are closed and which walls open and have portions spaced outwardly from the interior surfaces of the panels upon placing the panels in an angular relationship relative to one another to form a pocket, said walls assuming an angular relationship similar to that of the pair of panels when the pair of panels are angularly located relative to one another;

f) said panels having lower and upper edges and where the lower edges are sized and shaped to be supported on a flat surface so that the pocket is upwardly opening and the panels are vertically arranged when the card device is opened and in use;

g) means associated with a lower end of said pocket to retain an article to be presented to the recipient of the greeting card device within the pocket; and h) a waterproof liner secured to said walls and including an enclosing side wall and integral bottom for retention of water.

* * * * *